US008523656B2

(12) United States Patent
Saito

(10) Patent No.: US 8,523,656 B2
(45) **Date of Patent: *Sep. 3, 2013**

(54) GAMING MACHINE AND GAMING METHOD THEREOF

(75) Inventor: Hiroki Saito, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/220,672

(22) Filed: Aug. 29, 2011

(65) Prior Publication Data

US 2011/0312405 A1 Dec. 22, 2011

Related U.S. Application Data

(63) Continuation of application No. 12/133,081, filed on Jun. 4, 2008, now Pat. No. 8,029,354.

(30) Foreign Application Priority Data

Jun. 25, 2007 (JP) ..... 2007-166962

(51) Int. Cl.
*A63F 9/24* (2006.01)

(52) U.S. Cl.
USPC ..... 463/20; 463/25

(58) Field of Classification Search
USPC ..... 463/16–25
See application file for complete search history.

(56) References Cited

U.S. PATENT DOCUMENTS

| | | | |
|---|---|---|---|
| 6,394,902 | B1 | 5/2002 | Glavich et al. |
| 7,094,148 | B2 | 8/2006 | Baerlocher et al. |
| 2004/0033827 | A1 | 2/2004 | Gilmore et al. |
| 2004/0067791 | A1 | 4/2004 | Glavich et al. |
| 2004/0092300 | A1 | 5/2004 | Gauselmann |
| 2004/0266510 | A1 | 12/2004 | Kojima |
| 2005/0070354 | A1 | 3/2005 | Baerlocher et al. |
| 2005/0266916 | A1 | 12/2005 | Sato et al. |
| 2005/0282607 | A1 | 12/2005 | Gauselmann |
| 2006/0205480 | A1 | 9/2006 | Glavich et al. |
| 2006/0287062 | A1 | 12/2006 | Okada |
| 2007/0021189 | A1 | 1/2007 | Sato |
| 2007/0167215 | A1 | 7/2007 | Majima et al. |
| 2007/0232382 | A1 | 10/2007 | Berman |

FOREIGN PATENT DOCUMENTS

| | | | |
|---|---|---|---|
| CN | 1572347 | A | 2/2005 |
| JP | 2001-29536 | A | 2/2001 |

*Primary Examiner* — Masud Ahmed
(74) *Attorney, Agent, or Firm* — Lexyoume IP Meister, PLLC.

(57) ABSTRACT

A gaming environment is described. If the predetermined condition is met and the free game is shifted, reels are changed to other reels to be used in the free game. Also, in the free game, reel display portion on which the WILD symbols are displayed on all of the symbol display portions, the reel display portion is held in following games. The WILD symbols are consecutively displayed with the predetermined number (which is greater or equal to the number of symbol display portions of one reel display portion) on the reels used in the free game. Therefore, the probability where WILD symbols fill on the all of the can be enhanced, one or more aspects of the invention can provide higher interest to the player.

6 Claims, 24 Drawing Sheets

FIG. 12

| OF A KIND / SYMBOL | 3 | 4 | 5 |
|---|---|---|---|
| A | 5 | 10 | 15 |
| K | 4 | 8 | 12 |
| Q | 4 | 8 | 12 |
| J | 4 | 8 | 12 |
| 7 | 3 | 6 | 9 |
| ♥ | 3 | 6 | 9 |

FIG. 15

| REEL | |
|---|---|
| CODE NUMBER | SYMBOL |
| 00 | K |
| 01 | THUNDER |
| 02 | J |
| 03 | Q |
| 04 | HEART |
| 05 | A |
| 06 | Q |
| 07 | THUNDER |
| 08 | J |
| 09 | K |
| 10 | Q |
| 11 | A |
| 12 | J |
| 13 | HEART |
| 14 | K |
| 15 | THUNDER |
| 16 | K |
| 17 | A |
| 18 | Q |
| 19 | K |
| 20 | THUNDER |
| ⋮ | ⋮ |
| ⋮ | ⋮ |
| ⋮ | ⋮ |

FIG. 16

| RANDOM NUMBER VALUE | CODE NUMBER |
|---|---|
| 0~127 | 00 |
| 128~301 | 01 |
| 302~400 | 02 |
| 401~450 | 03 |
| 451~461 | 04 |
| 462~480 | 05 |
| 481~500 | 06 |
| 501~641 | 07 |
| 642~1000 | 08 |
| 1001~1129 | 09 |
| 1130~1580 | 10 |
| 1581~1582 | 11 |
| 1583~1585 | 12 |
| 1586~1650 | 13 |
| 1651~1668 | 14 |
| 1669~2000 | 15 |
| 2001~2176 | 16 |
| 2177~2303 | 17 |
| 2304~2431 | 18 |
| 2432~2455 | 19 |
| 2456~2516 | 20 |
| ⋮ | ⋮ |
| ⋮ | ⋮ |
| ⋮ | ⋮ |

FIG. 17

| RANDOM NUMBER VALUE | SYMBOL |
|---|---|
| 0~127 | K |
| 128~301 | THUNDER |
| 302~400 | J |
| 401~450 | Q |
| 451~461 | HEART |
| 462~480 | A |
| 481~500 | Q |
| 501~641 | THUNDER |
| 642~1000 | J |
| 1001~1129 | K |
| 1130~1580 | Q |
| 1581~1582 | A |
| 1583~1585 | J |
| 1586~1650 | HEART |
| 1651~1668 | K |
| 1669~2000 | THUNDER |
| 2001~2176 | K |
| 2177~2303 | A |
| 2304~2431 | Q |
| 2432~2455 | K |
| 2456~2516 | THUNDER |
| ⋮ | ⋮ |
| ⋮ | ⋮ |
| ⋮ | ⋮ |

FIG. 18

| RANDOM NUMBER VALUE | WINNING COMBINATION | | | | | | | | |
|---|---|---|---|---|---|---|---|---|---|
| 0~10 | THUNDER | – | any | – | any | – | THUNDER | – | THUNDER |
| 11~50 | Q | – | HEART | – | K | – | HEART | – | A |
| 51~65 | Q | – | K | – | Q | – | Q | – | Q |
| 66~80 | | – | | – | | – | | – | |
| 81~95 | HEART | – | HEART | – | HEART | – | any | – | HEART |
| ⋮ | ⋮ | – | ⋮ | – | ⋮ | – | ⋮ | – | ⋮ |

| REEL DISPLAY PORTION | FLAG |
|---|---|
| REEL DISPLAY PORTION 105 | 1 |

| REEL DISPLAY PORTION | FLAG |
|---|---|
| REEL DISPLAY PORTION 102 | 1 |
| REEL DISPLAY PORTION 105 | 1 |

GAMING MACHINE AND GAMING METHOD THEREOF

CROSS-REFERENCE TO RELATED APPLICATIONS

This application is a Continuation of U.S. patent application Ser. No. 12/133,081 filed Jun. 4, 2008, which application claims priority to Japanese Patent Application No. JP2007-166962 filed on Jun. 25, 2007, the entire contents of which are incorporated herein by reference.

BACKGROUND

1. Field

One or more aspects of the present invention relate to a gaming machine and gaming method thereof that uses reels.

2. Description of Related Art

Conventionally, gaming machines which use video reels are well known. In the conventional gaming machines, when a predetermined condition is met, a free game is executed and a gaming session is developed with a beneficial condition for a player.

Also, some conventional gaming machines have a primary game and a secondary game. If a predetermined condition is met, the secondary game which is beneficial for the player is executed. Also, reels to be used are different in the primary game and the secondary game.

In the conventional gaming machines, the beneficial reel for the player is used in the free game. However, a particular process is not executed even though wild symbols fill on some reel, and next game is stared. Also, in the conventional gaming machines, alignment of the wild symbols on the reel is not considered.

Also, in the conventional gaming machine, since there is little possibility that only the wild symbols are displayed all of the reels on display, the player's interest for the free game may be decreased.

SUMMARY

In view of the foregoing, one or more aspects of the present invention relate to a gaming machine, a gaming method thereof, a computer readable medium having computer-executable instructions or the like in which many same predetermined symbols can be displayed on a display at once. Also, if the predetermined condition is met and the free game is shifted, reels are changed to other reels to be used in the free game. Also, in the free game, reel display portion on which the WILD symbols are displayed on all of the symbol display portions, the reel display portion is held in following games. The WILD symbols are consecutively displayed with the predetermined number (which is greater or equal to the number of symbol display portions of one reel display portion) on the reels used in the free game. Therefore, the probability where WILD symbols fill on the all of the can be enhanced, one or more aspects of the invention can provide higher interest to the player.

One or more of the above aspects of the invention will be more fully described in the following detailed description when read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

FIG. 12 is a view showing contents of payout table of the slot machine according to one or more aspects of the invention.

FIG. 15 is a view showing a table in which each of code numbers corresponds to symbol in the slot machine according to one or more aspects of the invention.

FIG. 16 is a view showing a table in which random number values correspond to code number in the slot machine according to one or more aspects of the invention.

FIG. 17 is a view showing a table in which random number values correspond to symbol in the slot machine according to one or more aspects of the invention.

FIG. 18 is a view showing a table in which random number values correspond to winning combination in the slot machine according to one or more aspects of the invention.

DETAILED DESCRIPTION

Figure 1A:
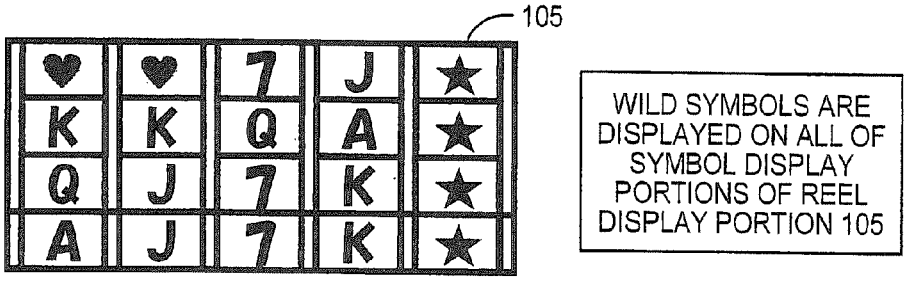
FIG. 1 is a view showing a condition where reel is held according to one or more aspects of the invention.

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine according to one or more aspects of the invention will be described in detail with reference to the drawings based on an embodiment embodying one or more aspects of the invention as a slot machine. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU" and "processor" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

In a slot machine related to an embodiment embodying one or more aspects of invention, special reels which are beneficial for the player are used in a free game. Here, WILD symbols are consecutively displayed with a predetermined number and above on the special reels. If the WILD symbols are displayed on the entire reel display portion (reel display portion 105 in FIG. 1A) in the free game, the reel is held without variably displaying on the reel display portion 105 in following games (FIG. 1B). Further, if the WILD symbols are displayed on the entire reel display portion (reel display portion 102 in FIG. 1C) in the following game, the reel is held without variably displaying on the reel display portion 102 in following games (FIG. 1D). Therefore, the probability where same symbols fill on the all of the can be enhanced, one or more aspects of the invention can provide higher interest to the player.

The embodiment embodying one or more aspects of the invention as a slot machine will be described in detail with reference with drawings.

Figure 2:
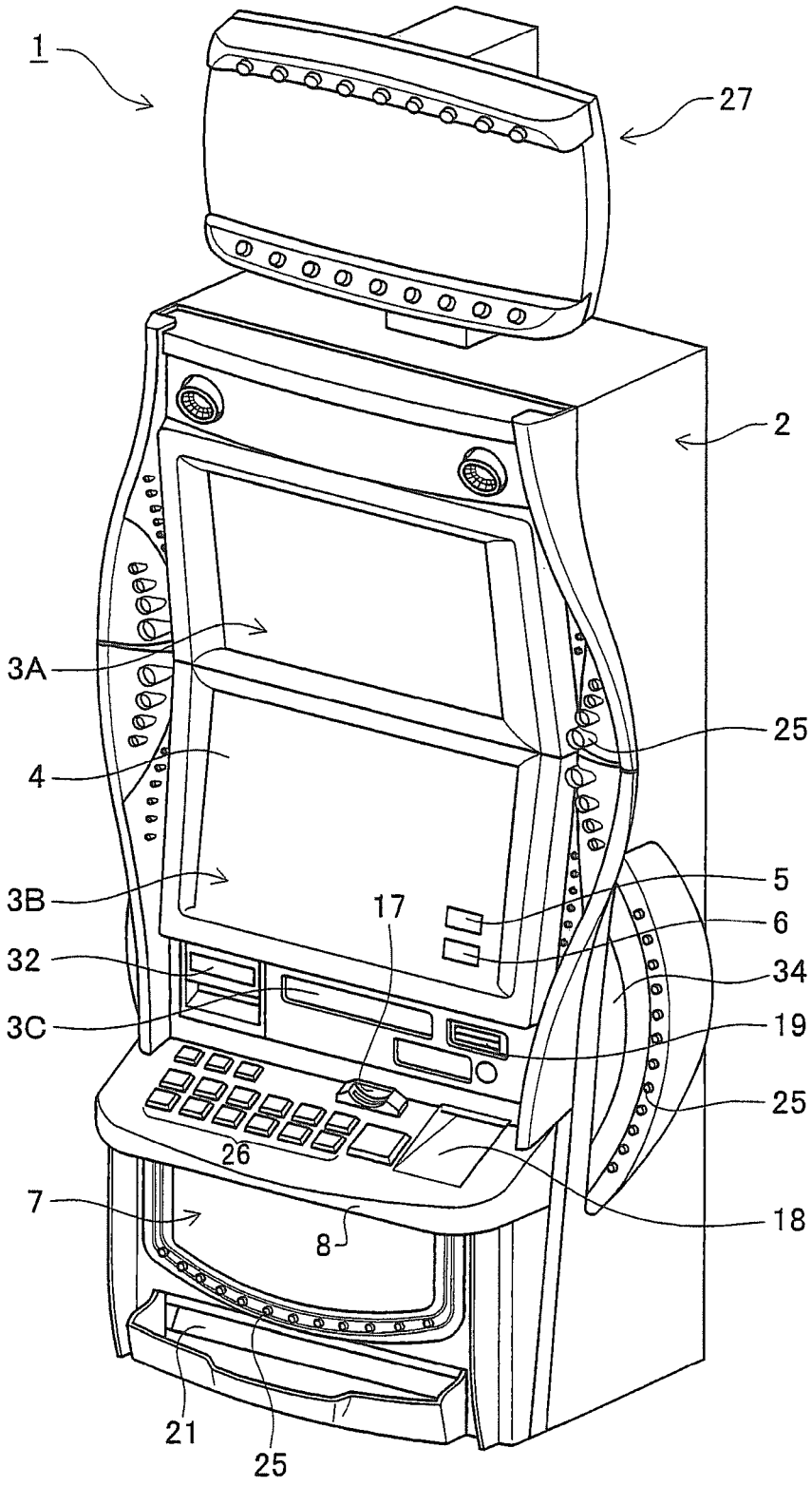
FIG. 2 is a perspective view showing an outer appearance of a slot machine according to one or more aspects of the invention.

At first, a schematic configuration of a slot machine 1 according to the first embodiment will be described with reference to FIG. 2. FIG. 2 is a perspective view showing an outer appearance of the slot machine 1 according to the first embodiment.

The slot machine 1 according to the first embodiment is an upright-type slot machine positioned in a gaming arcade such as a casino or the like.

The slot machine 1 has a cabinet 2. The cabinet 2 is a housing portion that houses electrical or mechanical components which are used in execution of a predetermined game aspect.

An upper display portion 3A, a variably display portion 3B, and an under display portion 3C are arranged in front of the slot machine 1 so as to display different type of game information. The upper display portion 3A is arranged upper side of the cabinet 2, the variably display portion 3B is arranged middle side of the cabinet 2, and the under display portion 3C is arranged lower side of the cabinet 2.

The upper display portion 3A is constructed from a liquid crystal panel. Effects images, payout tables of games, game rules, or the like are displayed on the upper display portion 3A.

Figure 3:
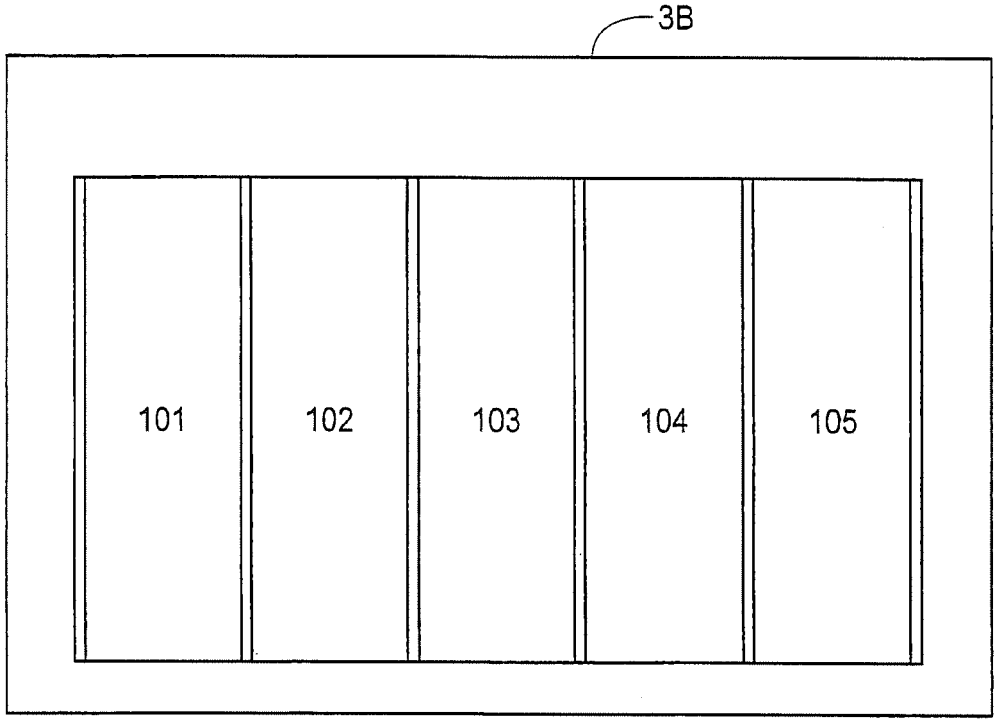
FIG. 3 is a view showing reel display portions of the slot machine according to one or more aspects of the invention.
Figure 4:
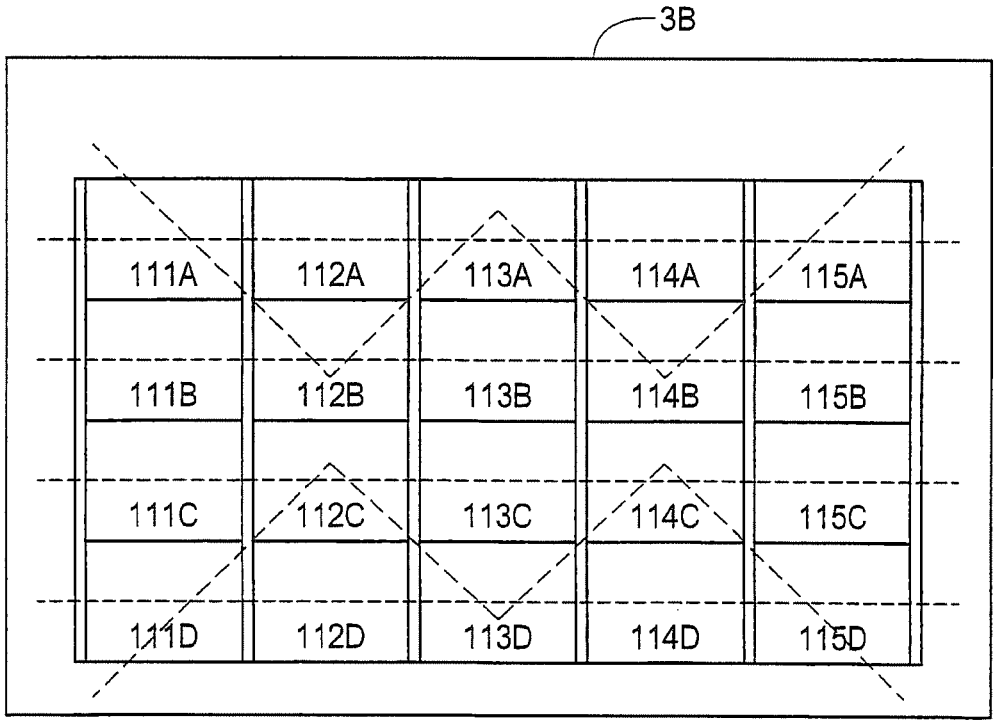
FIG. 4 is a view showing symbol display portions of the slot machine according to one or more aspects of the invention.

The variably display portion 3B is constructed from a liquid crystal panel. The variably display portion 3B has five rows of reel display portions 101 to 105 as shown in FIG. 3, for example. On each of the reel display portions, symbol rows are variably displayed and stopped displayed. On each of the reel display portions 101 to 105, four symbols are displayed respectively. That is, on the variably display portion 3B, as shown in FIG. 4, the symbols are displayed with 4×5 matrix shape. Also, the reel display portions 101 to 105 have symbol display portions 111A to 111D, 112A to 112D, 113A to 113D, 114A to 114D, and 115A to 115D respectively. Also, the number of the reel and the number of displayed symbol per reel display portion are variable. Also, in FIG. 4, a part of paylines are shown with dotted lines. In one or more aspects of the invention, the number of the paylines is variable and may be 25, 50, or 100, for example.

A touch panel 4 is provided at a front face of the variably display portion 3B. The player can operate the touch panel 4 to input various types of commands. Also, a payout number display portion 5 and a credit number display portion 6 are arranged on the variably display portion 3B (see FIG. 2). The displayed position of the payout number display portion 5 and the credit number display portion 6 are variable. For example, these are displayed on lower right side portion of the variably display portion 3B. Also, a bet number display portion may be arranged so as to display bet number. The payout number which will be provided to the player (that is, payout number to be provided when predetermined symbols are displayed with the predetermined number in a base game and accumulated payout number obtained in free games) are displayed on the payout number display portion 5. The credit number which the player currently owns is displayed on the credit number display portion 6.

The under display portion 3C is constructed form a liquid crystal panel. Number of points stored in a card and/or number of game points are displayed on the under display portion 3C. Also, when the card is not inserted and/or error of reading the card occurs, message which indicates that is displayed.

Also, a card reader 19 is arranged around the under display portion 3C. The card reader 19 can read information from the card in which the player owns.

The upper display portion 3A, the variably display portion 3B, and the under display portion 3C are constructed from the liquid display for example, however, one or more aspects of the invention is not so limited. That is, each of the variably display portion can be CRT displays, plasma displays, LED displays, or other known display devices.

A lower back panel 7 is arranged lower side of the under display portion 3C and is constructed from plastic panel. Character pictures related to the gaming machine, name of the gaming machine, and the like are displayed and the lower back panel is lit by the backlight. The lower back panel 7 can be CRT displays, plasma displays, LED displays, or other known display devices.

Also, the variably display portion 3B can be hybrid type slot machine which is made up of mechanical reels and transparent liquid crystal display device arranged in front of the mechanical reels. In this case, symbols displayed on the mechanical reels are visible perceived via the transparent liquid crystal display device. Also, it is preferable that display windows whose number is the same as the number of the mechanical reels is arranged on the transparent liquid crystal display device and it is constructed so that symbols displayed on the mechanical reels are visible perceived via the window displays. Here, in following explanation, slot machines using video reels are mainly described, however, naturally, the present invention is can be applied to slot machines using mechanical reels within applicable limits.

An operation table 8 formed by projecting to proximal side is provided at the bottom of the variably display portion 3B. Various operation buttons 26, such as an exchange button, a payout button, a help button, a bet button, and start button or the like, are arranged on the operation table 8. An arrangement of these buttons is variable. Also, a part of the buttons can be omitted, and new button can be added or replaced, as needed. Also, a coin insertion slot 17 and a bill verifier 18 are arranged on the operation table 8.

Also, a coin payout opening and a coin insertion portion 21 is formed on lower portion of the cabinet 2. The coin payout opening is a portion where coins are paid out based on inputs of the exchange button or the payout button. And, the coin insertion portion 21 is a portion where the coins which are paid out from the coin payout portion 20 are received. A coin detection portion made up of sensor or the like is arranged inside the coin payout opening. The coin detection portion detects the number of coins which are paid out from the payout opening.

Light emitting portions 25, which lights up in a predetermined lighting pattern when winning combination is realized and during the free game, are arranged around the cabinet 2 of the slot machine 1. Loudspeakers 34 which outputs audio are arranged at side of the cabinet 2. Here, arranged positions of the light emitting portion 25 and the loudspeaker 34 are variable.

The slot machine 1 has a topper effect device 27 provided at an upper side of the cabinet 2. This topper effect device 27 has a rectangular board shape and is arranged so as to be substantially parallel with the upper display portion 3A. Here, the shape of the topper effect device 27 is variable. Different types of information are displayed on the topper effect device 27.

Figure 5:
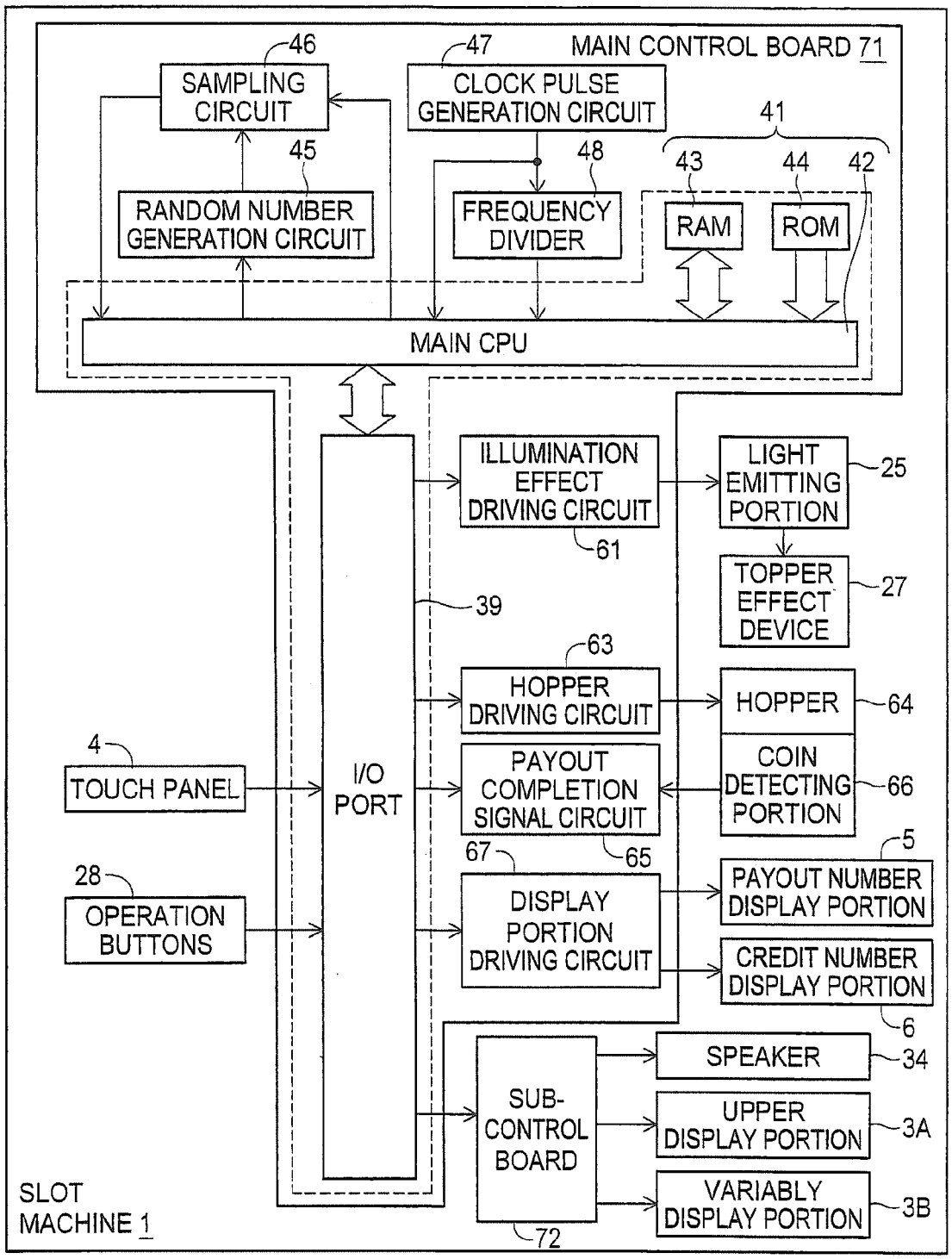
FIG. 5 is a block diagram showing an internal configuration of the slot machine according to one or more aspects of the invention.
Figure 6:
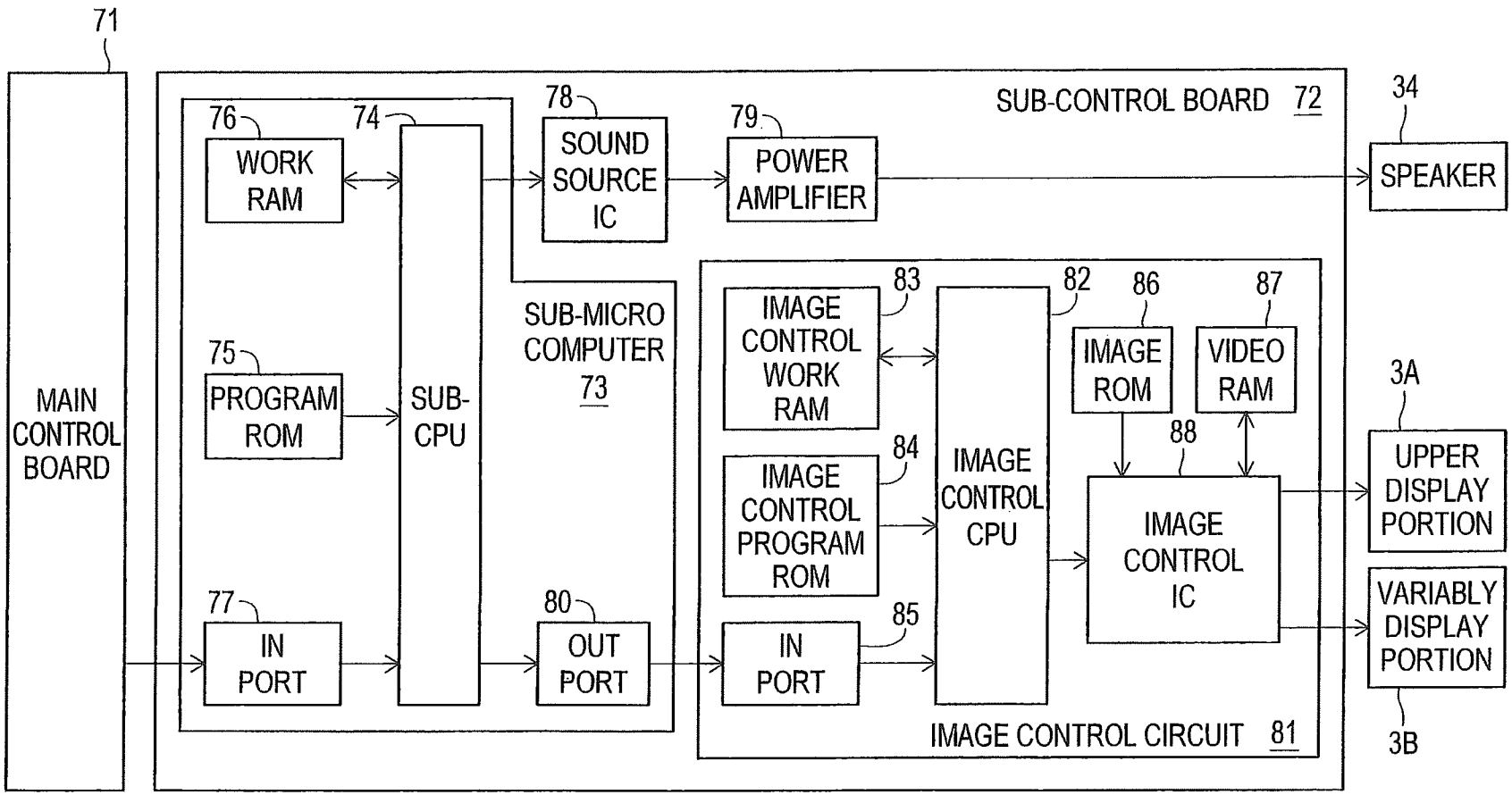
FIG. 6 is a block diagram showing an internal configuration of a sub-control board of the slot machine according to one or more aspects of the invention.

Next, the internal configuration of the above-mentioned slot machine 1 will be described with reference to FIG. 5 and FIG. 6. FIG. 5 is a block diagram showing an internal configuration of the entire slot machine 1. As shown in FIG. 6, the slot machine 1 has a plurality of constituent elements arranged around a main control board 71 including a controller 41 that executes control programs that will be described later. The main control board 71 has a controller 41, a random number generation circuit 45, a sampling circuit 46, a clock pulse generation circuit 47, a divider 48, an illumination effect driving circuit 61, a hopper driving circuit 63, a payout completion signal circuit 65 and a display portion driving circuit 67.

The controller 41 has a main CPU 42, a RAM 43 and a ROM 44. The main CPU 42 operates in accordance with the programs stored in the ROM 44 and performs signal input and output with respect to the other constituent elements through an I/O port 49. Specifically, the main CPU 42 controls the operation of the entire slot machine 1. The RAM 43 stores data and programs to be used when the main CPU 42 is operating. For instance, the RAM 43 temporarily retains the random number values which have been sampled by the sampling circuit 46 after the game has started. The RAM 43 stores code numbers corresponding to the respective reels 101 through 105. The ROM 44 stores various types of programs that will be executed by the main CPU 42, as well as permanent data.

More particularly, the programs stored in the ROM 44 include game programs and game system programs (hereinafter referred to as game programs or the like). Further, the game programs include lottery programs as will be described later.

The lottery programs are used to determine the code numbers corresponding to symbols to be displayed on center positions of each reel display portion 101 to 105 (namely, symbol display portion "111B, 112B, 113B, 114B, and 115B" or "111C, 112C, 113C, 114C, and 115C") of the variably display portion 3B.

This lottery program includes symbol weighing data. The symbol weighing data shows correspondence relationships between the respective code numbers and one or a plurality of random number values within a predetermined number value range (for instance 0 through 255). The probability of lottery with respect to each symbol is set by associating one or a plurality of random number values to one code number. The random number values are drawn by lottery and symbols which have been finally identified from the random number values are re-positioned on the variably display portion 3B. The lottery program for determining the symbols to be positioned may also employ weighing data in which the predetermined random number range is associated to the symbol combination. In this case, determined winning combination is displayed on the variably display portion 3B.

The random number generation circuit 45 operates in accordance with the commands from the main CPU 42 and generates random numbers within a predetermined range. The sampling circuit 46 selects, by lottery, an arbitrary random number from the random numbers generated by the random number generation circuit 45 in response to a command from the main CPU 42. At the same time, the sampling circuit 46 inputs the random number thus selected to the main CPU 42. The clock pulse generation circuit 47 generates a reference clock for causing the main CPU 42 to operate. The divider 48 inputs a signal obtained by dividing the reference clock by a constant frequency to the main CPU 42.

The main control board 71 is connected to the touch panel 4. As described above, the touch panel 4 is arranged at a front face of the variably display portion 3B and is adapted to identify a coordinate position of the portion that was touched by the player. Specifically, the touch panel 4 can discriminate the portion that the player has touched, and in what direction the touched portion was moved based on the coordinate position information that was thus identified. A signal in accordance with the above discrimination is then inputted to the main CPU 42 through the I/O port 49.

The main control board 71 is connected to the operation button 26 (the start button and the like, as mentioned above) and a signal in accordance with a depression operation of these buttons is inputted to the main CPU 42 through the I/O port 49.

The illumination effect driving circuit 61 outputs an effect signal for causing the light emitting portions 25 and the topper effect device 27 as mentioned above to perform illumination effects. The topper effect device 27 is connected in series with the illumination effect driving circuit 61 through the light emitting portions 25.

The hopper driving circuit 63 drives the hopper 64 under the control of the main CPU 42. As a result, the hopper 64 carries out an operation to payout coins to the coin payout opening. The payout completion signal circuit 65 receives coin amount value data from the coin detecting portion 24 to which it is connected. Then, when the received coin amount value has reached the set coin amount value, the payout completion signal circuit 65 inputs a signal that notifies completion of coin payout to the main CPU 42. The coin detecting portion 24 detects the number of coins that were paid out by the hopper 64 and then inputs coin amount value data showing the amount of coins that was detected to the payout completion signal circuit 65. The display portion driving circuit 67 controls the display operation of the respective display portions including the payout number display portion 5, the payout number display portion 6, and the like.

The main control board 71 is connected to the sub-control board 72. As shown in FIG. 6, the sub-control board 72 carries out display control of each of the display portion and output control of the audio outputted by the loudspeaker 34, based on the commands received from the main control board 71. This sub-control board 72 is constituted on a separate circuit board from the circuit board that constitutes the main control board 71. The sub-control board 72 has a micro computer (hereinafter referred to as "sub-micro computer") 73 which is provided as a main constituting element. Then, the sub-control board 72 has a sound source IC 78, a power amplifier 79, and an image control circuit 81. The sound source IC 78 controls the audio output from the loudspeaker 34. The power amplifier 79 functions as an amplifier. The image control circuit 81 operates as a display control section for the upper display portion 3A and the variably display portion 3B.

The sub-micro computer 73 has a sub-CPU 74, a program ROM 75, a work RAM 76 and I/O ports 77 and 80. The sub-CPU 74 carries out a control operation in accordance with a control command transmitted from the main control board 71. Although the sub-control board 72 does not have a clock pulse generation circuit, a divider, a random number generation circuit and a sampling circuit, it is constituted so as to execute sampling of random numbers based on an operation program of the sub-CPU 74. The program ROM 75 stores a control program to be executed by the sub-CPU 74. The work RAM 76 is constituted as a temporary memory to be used by the sub CPU 74 in executing the control program.

The image control circuit 81 has an image control CPU 82, an image control work RAM 83, an image control program ROM 84, an image ROM 86, a video RAM 87 and an image control IC 88. The image control CPU 82 determines the image to be displayed on the upper display portion 3A and the variably display portion 3B based on the parameters set in the sub-micro computer 73 and the image control programs stored in the image control program ROM 84. For example, the upper display portion 3A displays a payout table and a help screen. The variably display portion 3B carries out scrolled display and stopped display on the respective symbol display portions 111A to 111D, 112A to 112D, 113A to 113D, 114A to 114D, and 115A to 115D.

The image control program ROM 84 stores an image control program and various types of selection tables relating to display on the upper display portion 3A and the variably display portion 3B. The image control work RAM 83 functions as a temporary memory to be used in execution of the image control program in the image control CPU 82. The image control IC 88 forms an image in accordance with the contents determined by the image control CPU 82 and then outputs the image thus formed to the upper display portion 3A and the variably display portion 3B.

The image ROM 86 stores dot data for forming an image. The video RAM 87 functions as a temporary memory to be used by the image control IC 88 in forming an image.

Here, the internal construction of the slot machine 1 as mentioned above is merely one example and one or more aspects of the invention is not so limited. For example, memory card and/or PLD (Programmable Logic Device) may be detachably from the slot machine 1 and necessary information may be read from the memory card and/or the PLD.

The slot machine 1 of the first embodiment employs coins, bills or electronic value information (credit) corresponding to these, as gaming values. The gaming values applicable to the present invention are not limited to those described above, and can include, for instance, medals, tokens, electronic money and tickets.

Figure 7:
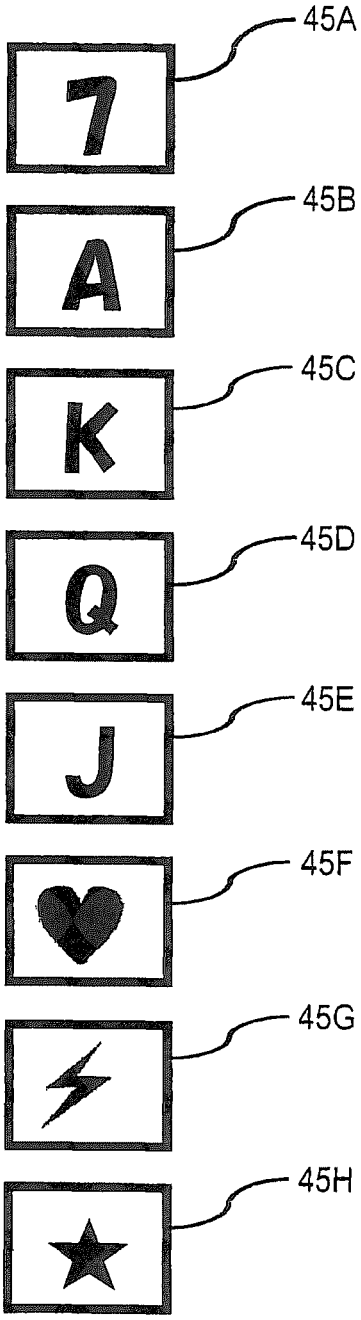
FIG. 7 is a view showing symbols displayed on each reel of the slot machine according to one or more aspects of the invention.

Next, the symbols which are variably displayed on the symbols display portion will be described with reference to FIG. 7. FIG. 7 is a view schematically showing the symbols displayed on the reels which are variably displayed on the reel display portions 101 to 105.

As shown in FIG. 7, the reel includes SEVEN symbol 45A, A (Ace) symbol 45B, K (King) symbol 45C, Q (Queen) symbol 45D, J (Jack) symbol 45E, HEART symbol 45F, THUNDER symbol (scatter symbol) 45G, and WILD symbol 45H. The number of the symbols which are displayed on one reel is variable and the type of the displayed symbols is variable.

Figure 8:
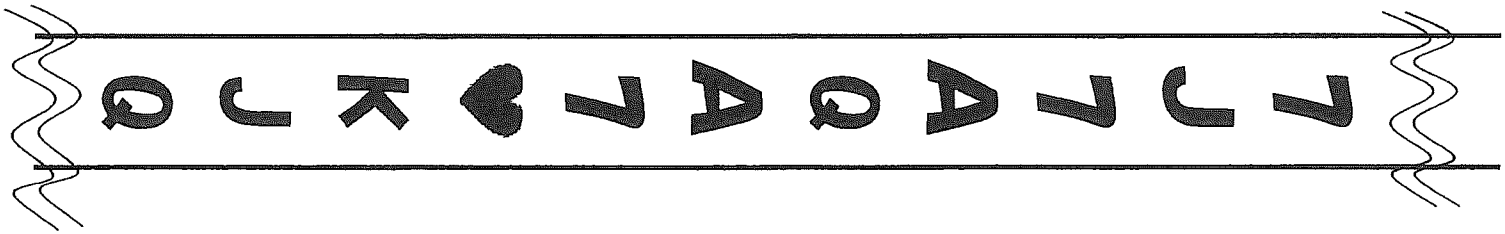
FIG. 8 is a view showing symbol rows displayed on each reel of the slot machine according to one or more aspects of the invention.

Symbols shown in FIG. 7 are displayed on the reel in predetermined order, as shown in FIG. 8. FIG. 8 shows the reel (outer reel) which are displayed on each reel display portion.

Next, a base game and a free game executed on the slot machine 1 having the above configuration will be described. In the base game, all of the symbols are scatter symbol. The base game is a game in which an award is provided based on the combination of the symbols on the payline which is set on the symbols display portions 111A to 111D, 112A to 112D, 113A to 113D, 114A to 114D, and 115A to 115D with 4×5 matrix (namely, matrix in 4 rows and 5 columns) shape on the variably display portion 3B, that is the base game is a payline-type game.

Figure 9:
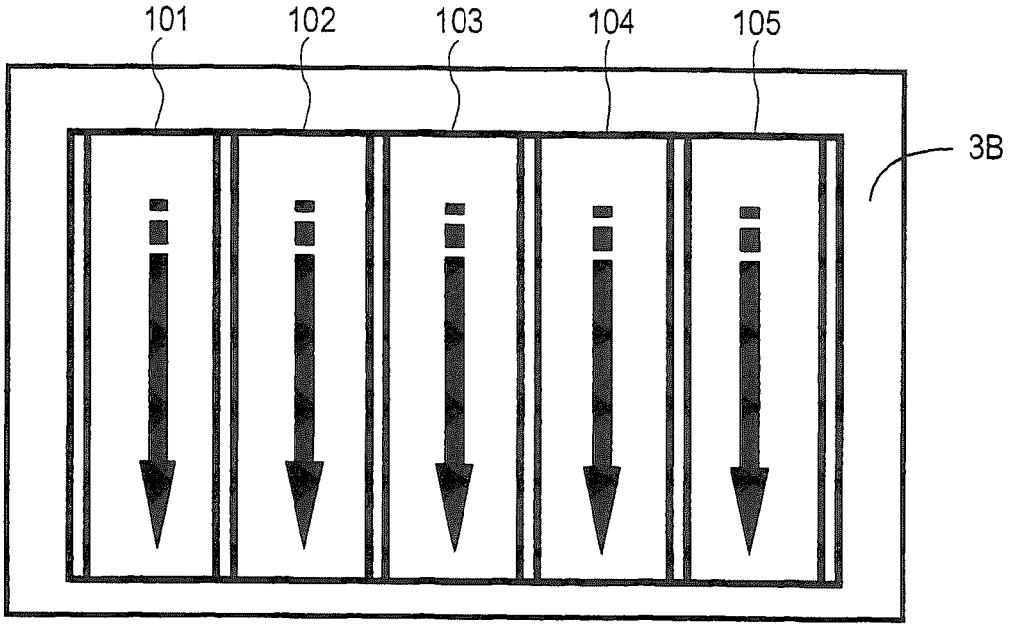
FIG. 9 is a view showing a condition where reels are variably displayed on variably displays of the slot machine according to one or more aspects of the invention.
Figure 10:
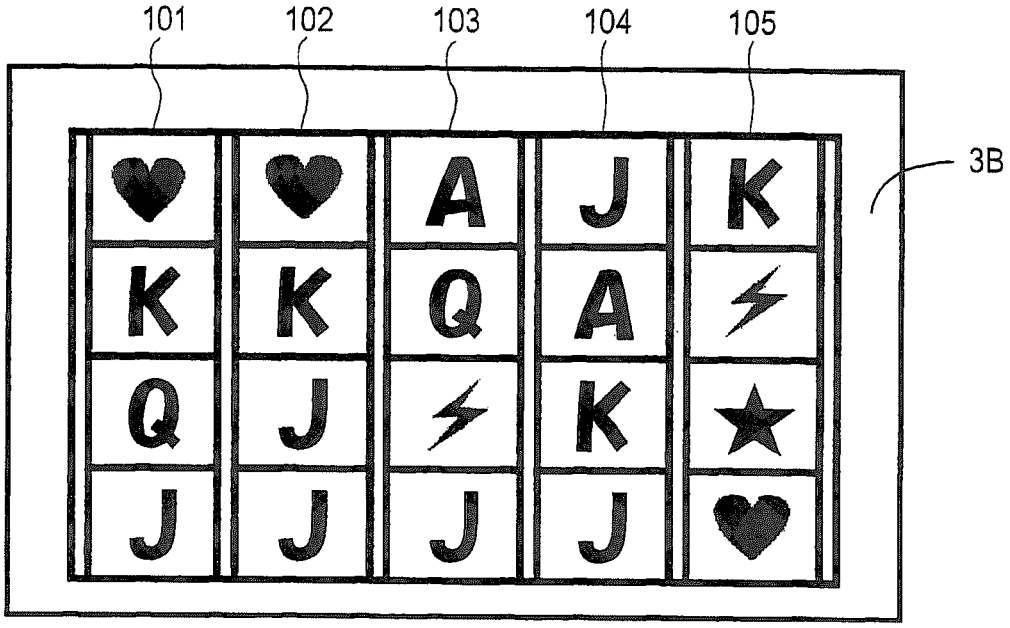
FIG. 10 is a view showing a condition where symbols are stopped displayed on variably displays of the slot machine according to one or more aspects of the invention.

When the bet count is determined based on the operation of the bet button, and then the start button is input, the reels start to spin on the each of the reel display portions 101 to 105. Accordingly, the symbol rows displayed on the reel are scrolled from top to bottom, as shown in FIG. 9. After a predetermined time, the reels are stopped displayed on the reel display portions 101 to 105. Accordingly, a part of the symbol rows of the reel (total of twenty symbols which three symbols on each reel display portion 101 to 105) are displayed in the symbol display portion on the variably display portion 3B respectively, as shown in FIG. 10. Here, scroll direction can be from the bottom to top not limited to from top to bottom. Also, the scroll direction can be different on each reel display portion. Also, the scroll direction can be different on each game.

In the base game, winning combination is determined based on the number of the same symbols on the payline and an award corresponding to the determined winning combination will be provided. If the winning combination is realized, amount of outcome, which the payout number corresponding to the winning combination is multiplied by the bet number, is provided to the player. This point will be described later.

Figure 11:
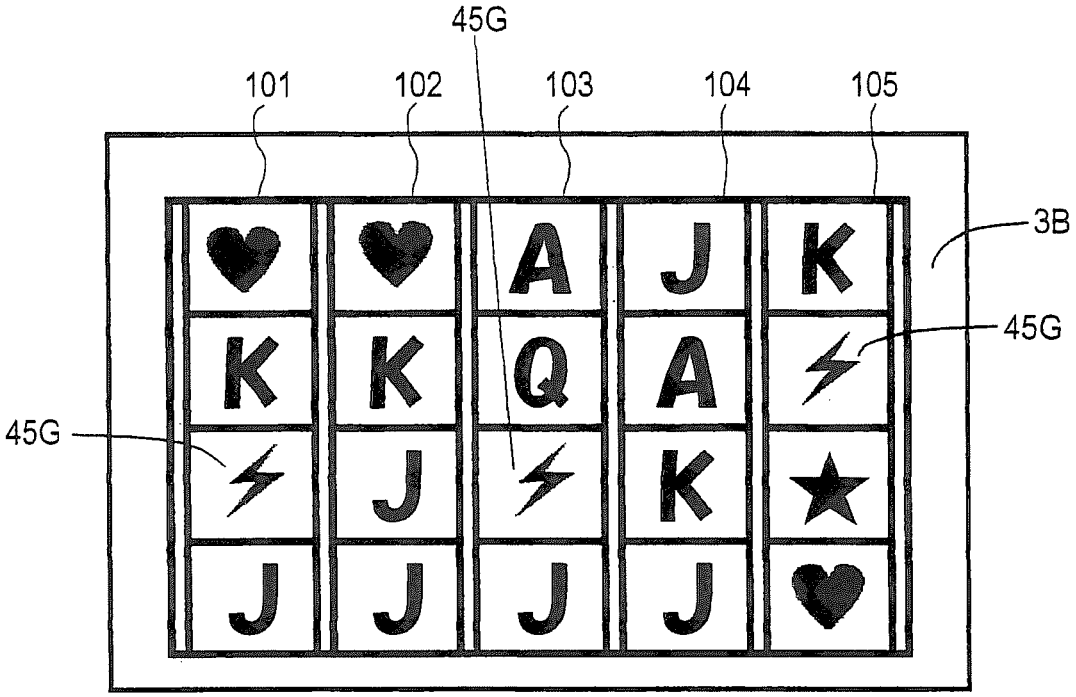
FIG. 11 is a view showing a condition where symbols are stopped displayed on variably displays of the slot machine according to one or more aspects of the invention.

On the other hand, the free game is a game which is switched-executed from the base game if the predetermined condition is met in the base game. Here, the predetermined condition can be a condition where the THUNDER symbols 45G (predetermined symbol) shown in FIG. 7 are displayed with a predetermined number (for example, three) and above (see FIG. 11).

The free games are executed with the predetermined number (for example, ten). After the free game is terminated, the game is changed to the base game again. Here, with respect to the procedure of the free game, the free game is the same as the base game, except that in the free game, gaming values (credits) corresponding to the bet amount are not consumed at the start of the game, and the game is continuously carried out automatically without requiring the player to operate the operation button. Here, the number of the executed free game is variable. Also, one or more aspects of the invention may have different types of the number of the free game to be executed, and the number of the free game to be executed can be selected based on a predetermined condition.

The winning combination and payout number thereof used in the base game and the free game in the slot machine 1 of the embodiment will be described with reference to FIG. 12. FIG. 12 shows payout table which indicates the winning combination and payout number thereof used in the base game and the free game. Here, in FIG. 12, if four of the Q symbols 45D are displayed, payout number "8" is provided, for example.

FIG. 12 indicates the payout number in the case where the bet count is "1". If the bet count is "1", the payout number shown in FIG. 12 will be provided. If the bet count is more than "1", the payout number shown in FIG. 12 will be multiplied by the bet count, and multiplied number will be provided. Here, the bet count in the free game is the same as the bet count of the latest base game.

For example, if three of "Q" symbols are displayed on the payline, amount of outcome which 4 credit is multiplied by the bet number will be provided to the player.

Also, if five of the "A" symbols 45B are displayed on the payline, amount of outcome which 15 credit is multiplied by the bet number will be provided to the player. Further, if four of the "K" symbols 45C are displayed on the payline, amount of outcome which 8 credit is multiplied by the bet number will be provided to the player.

In a similar way, the payout numbers are defined on each of the winning combinations shown in FIG. 12. Here, the combination on the payline not associated with any of the winning combinations shown in FIG. 12 is realized, the game is lost. If the game is lost, none of the payout number will be paid.

The WILD symbol 45H can substitute for any of symbols except the scatter symbol. Also, if the WILD symbols 45H are displayed on a predetermined number and above and/or the WILD symbols 45H are displayed all of twenty symbol display areas, a predetermined amount of outcome can be provided.

Figure 13:
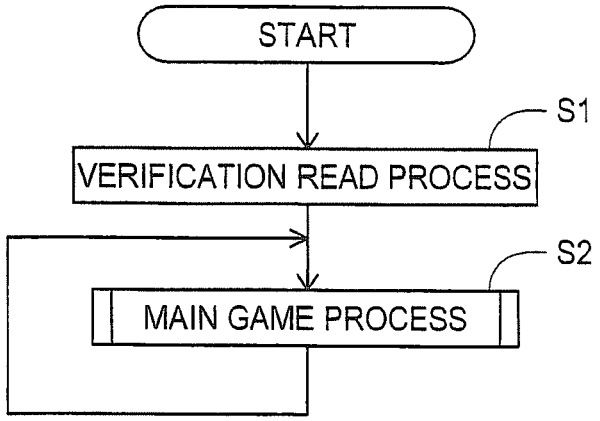
FIG. 13 is a flowchart of a main control process in the slot machine according to one or more aspects of the invention.

Next, a main control program executed in the slot machine 1 of the embodiment will be described in detail with reference to drawings. FIG. 13 is a flowchart of the main control program.

First, when the power switch is turned on (upon power on), the main control board 71 and the sub-control board 72 are activated, and the controller 41 executes an initial setting process at step (hereinafter referred to as 5) 1. In the initial setting process, the main CPU 42 executes the BIOS stored in the ROM 44 and expands the compressed data incorporated in the BIOS in the RAM 43. By executing the BIOS that was expanded in the RAM 43, the main CPU 42 carries out a diagnosis and initialization of the different types of peripheral devices. Further, the main CPU 42 writes the game programs and the like from the ROM 44 into the RAM 43 to acquire payout rate setting data and country identification information. While executing the initial setting process, the main CPU 42 also carries out an authentication process with respect to each program.

Then, at step S2, the main CPU 42 sequentially reads the game programs and the like from the RAM 43 and executes these programs to carry out a main game process. The slot machine 1 according to the embodiment carries out the game by executing this main game process. The main game process is repeatedly executed while power is supplied to the slot machine 1.

Figure 14:
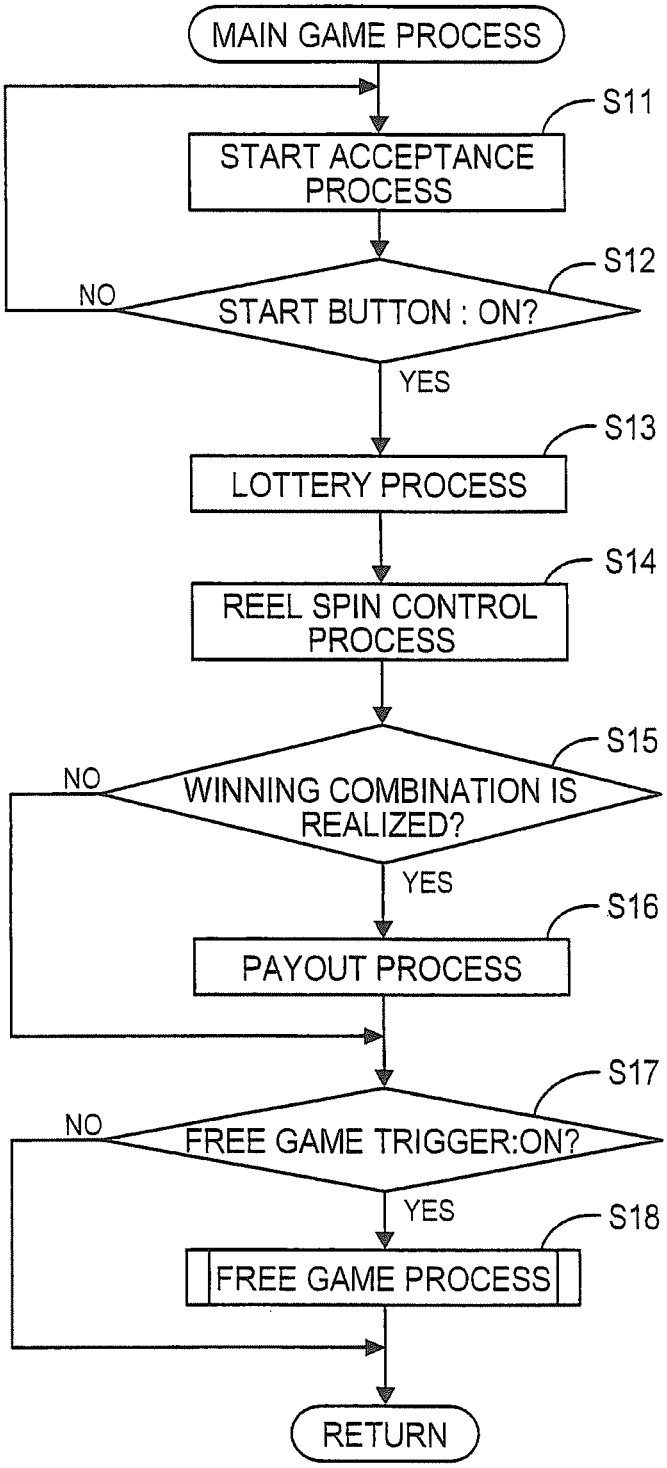
FIG. 14 is a flowchart of a main game process in the slot machine according to one or more aspects of the invention.

Next, a sub-process of the main game process at the above-described step S2 will be described based on FIG. 14. FIG. 14 is a flowchart of the main game process program to be executed in the slot machine 1 according to the embodiment. The programs shown in the flowcharts of FIG. 11 and FIG. 12 as will be described later are stored in the ROM 44 and RAM 43 provided in the slot machine 1 and are executed in the main CPU 42.

As shown in FIG. 14, the main CPU 42 first executes a start acceptance process at S11. In the start acceptance process, the player inserts coins and places a bet using the BET button from amongst the operation buttons 26.

At S12, the main CPU 42 determines whether or not the start button from amongst the operation buttons 26 has been depressed. This determination is carried out based on the signal inputted to the main CPU 42 in response to depression of the start button. Here, if the start button has not been depressed (S12: NO), the flow returns to the start acceptance process (S11). As a result, the player can carry out an operation to correct, etc. the bet amount. Alternatively, if the start button has been depressed (S12: YES), the main CPU 42 subtracts the bet amount set based on the above-described bet operation from the credit amount that the player currently possesses and at the same time stores the result as bet information in the RAM 43. After that, the procedure will be shifted to S13.

In S13, the symbol lottery process is executed. Concretely, the main CPU 42 samples random number value from a number value range within a predetermined random number value range by executing the lottery program store in the RAM 43, and determines symbols to be stopped on center positions of each reel display portion 101 to 105 (namely, symbol display portions "111B, 112B, 113B, 114B, and 115B" or "111C, 112C, 113C, 114C, and 115C") based on the sampled random number values and the table.

Here, a process using random number values in S13 will be described. FIG. 15 shows one example of a table in which symbols displaying on a reel belt correspond to code numbers. Each of reel display portions has the table. FIG. 16 shows one example of a table in which the random number values corresponds to the code numbers. The code numbers are determined with the use of the table shown in FIG. 16 based on the sampled random number values among predetermined random number range (for example, from 0 to 65535). The symbols to be stopped are determined with the use of the determined code numbers and the table shown in FIG. 15.

Here, as shown in FIG. 16, since the number of random number values corresponding to each code number is different, each of probabilities of appearance of each symbol shown in FIG. 16 is controlled. For example, in FIG. 16, code number "10" corresponds to random number values "1130" to "1580", code number "11" corresponds to "1581" to "1582". Therefore, since the code number "10" may more appear than the code number "11", "Q" symbol 45D corresponding to the code number "10" may more appear than the "A" symbol 45B corresponding to the code number "11".

For example, with respect to the reel display portion 101, in a case where reel shown in FIG. 15 is used and "660" is sampled, it is determined that code number is "08" based on the table shown in FIG. 16. And then, it is determined that the J symbol 45E corresponding to the code number "08" will be displayed on the symbol display portion 111B with the use of the table shown in FIG. 15.

Also, as shown in FIG. 17, the random number values to be sampled may correspond to symbols.

Also, as shown in FIG. 18, the random number values to be sampled may correspond to winning combinations and the symbols to be stopped may be determined with the use of the table. In FIG. 18, winning combination is determined beforehand based on the sample random number value, and it is stopped-controlled so that the determined symbols are stopped on the predetermined symbol display portion. Also, in FIG. 18, if code number "70" is sample, it means "lose".

Returning to FIG. 14, in S14, the main CPU 42 carries out a reel spin control process. Specifically, the main CPU 42 variably displays each of the reels on the reel display portions 101 to 105. After that, the main CPU 42 determines effects pattern (image display pattern of the variably display portion 3B, sound output pattern of the loudspeaker 34, or the like) in a unit game and send predetermined signal to sub-control board 72 so as to start effects based on the determined effects pattern. Here, the unit game means a sequence of process where each of the reels starts to variably display and then the entire reels are stopped displayed. Then, after the lapse of a predetermined period of time, reels are stopped to spin on the reel display portions 101 to 105 in predetermined order. Therefore, symbols are stopped displayed on symbol display portions 111A to 111D, 112A to 112D, 113A to 113D, 114A to 114*d*, and 115A to 115D. Here, with respect to the stops of the spinning reels on the reel display portions, the entire reel can be stopped at once or each of the reels can be stopped in turn.

After that, in S15, the main CPU 42 determines whether or not the symbols arranged on the variably display portion 3B correspond the winning combination. This determination is performed based on the code numbers of each reel display portion 101 to 105 stored in the RAM 43.

At a result, if it is determined that the winning combination is realized (S15:YES), the procedure will be shifted to S16. On the other hand, if it is determined that none of the winning combinations is not realized (S15:NO), the procedure will be shifted to S17. Here, if a game will be ongoingly started in next time, the process of S13 and later will be executed again.

In S16, the main CPU 42 provides the payout number corresponding to the winning combination which is determined in S15 to the player.

Next, in S17, the main CPU 42 determines whether or not a free game start trigger is realized. As mentioned above, a condition of shifting may be displaying of the predetermined symbols are displayed with the predetermined number.

If it is determined that the free game start trigger is realized (S17:YES), the procedure will be shifted to a free game process (S18), and the game is changed from the base game to the free game. Here, detail of the free game process will be described later. On the other hand, if it is determined that the free game start trigger is not realized (S17:NO), the procedure will be terminated.

(First Embodiment of Free Game)

Figure 19A:
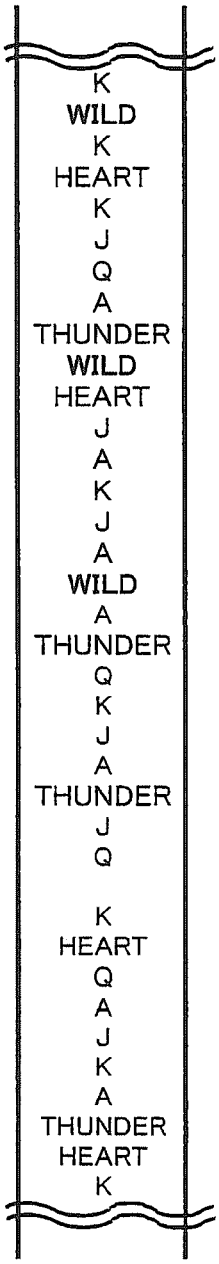
FIG. 19 is a view showing reels in the slot machine according to one or more aspects of the invention.
Figure 19B:
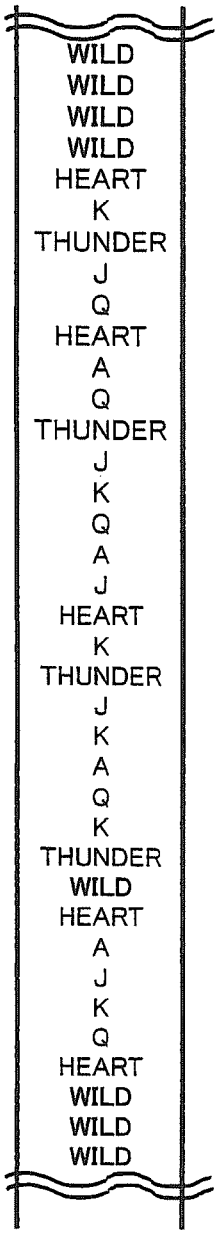

Next, a free game will be described. In the embodiment, gaming session of the free game is developed with the use of two types of reels, which are the reel which is used in the base game (hereinafter, "base reel 55") and special reel 56. FIGS. 19A and 19B show simple views of the base reel 55 and the special reel 56. Here, the special reel 56 is beneficial reel for the player. That is, as shown in FIGS. 19A and 19B, in the special reel 56, the number of the WILD symbols 45H is increased and the number of consecutive arranged WILD symbols 45H is increased compared to the base reel 55. Here, alignment of symbols on the reel shown in FIG. 19 is a merely example. Also, the number of the consecutive arranged WILD symbols 45H is greater or equal to the number of the symbol display portions on one reel display portion (this number is 4 in this embodiment, 4).

Figure 20:
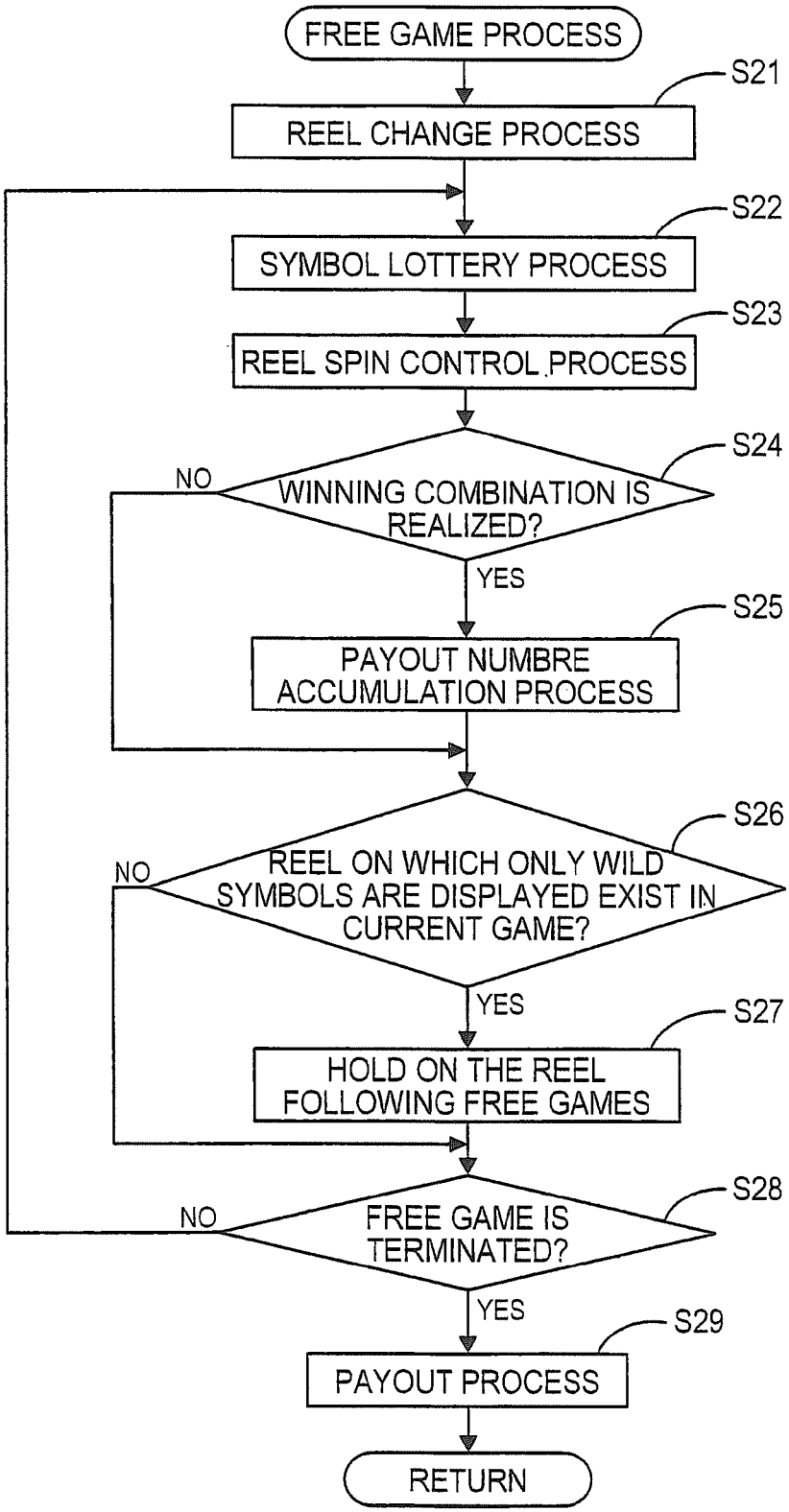
FIG. 20 is a flowchart of a free game process in the slot machine according to one or more aspects of the invention.
Figure 21:
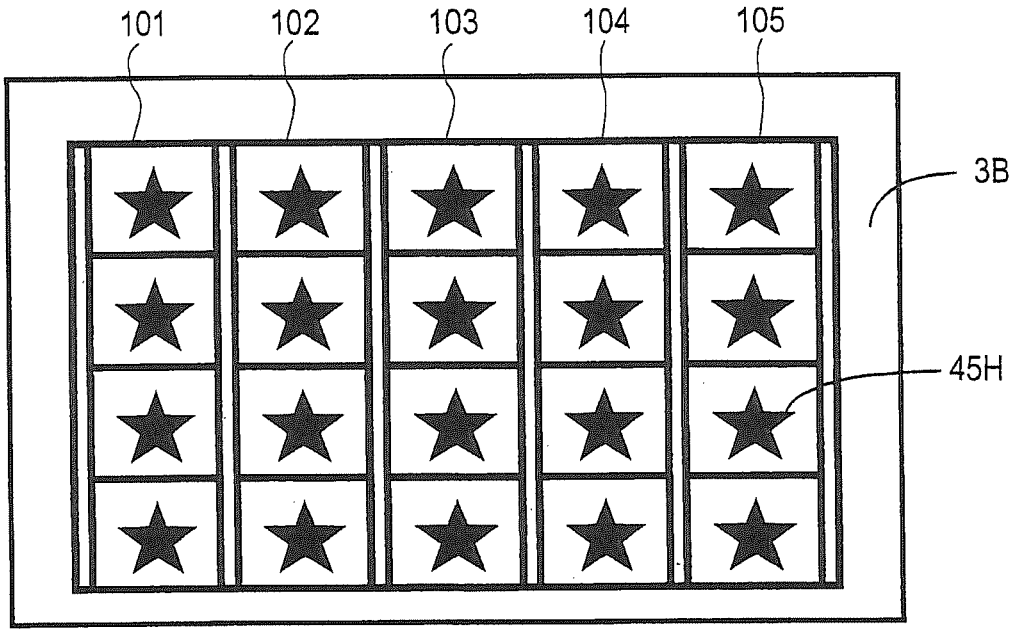
FIG. 21 is a view showing a condition where symbols are stopped displayed on variably displays of the slot machine according to one or more aspects of the invention.

The free game in this embodiment will be described in detail with reference to FIG. 20.

In S21, reels used in the free game are changed to the special reels. Since the processes of S22 and S23 are the same as S13 and S14 in the main game process, explanation thereof will be omitted.

In S24, it is determine whether or not the combination of symbols displayed on the payline is any of the winning combinations. If it is determined that the combination is any of the winning combinations (S24:YES), the procedure will be shifted to S25. On the other hand, if it is determined that the combination is none of the winning combinations (S24:NO), the procedure will be shifted to S26.

In S25, the payout number is accumulated. The accumulated payout number will be provided to the player in S29.

In S26, with respect to each of the reel display portions, it is determined whether or not the WILD symbols are displayed the entire symbol display portions in current game. If it is determined that the WILD symbols are displayed the entire symbol display portions on the reel display portion (S26:YES), the reel on this reel portions will be held until the free game is terminated (S27). Here, the number of the free game which the reel is held is variable. Also, the reel can be held during the predetermined times of the free game.

In S28, it is determined whether or not the free game is terminated. This determination is based on whether the free game is executed with the predetermined number. If it is determined that the free game is not terminated (S28:NO), the procedure will be returned to S22 and the process is executed. On the other hand, if it is determined that the free game is terminated (S28:YES), the procedure will be shifted to S29 and the accumulated payout number will be provided to the provided. After that, the free game is terminated.

c Here, each of the flowcharts as mentioned above is a merely example, and one or more aspects invention may be implemented by other flowchart(s) which can obtain the same result of above processes.

FIG. 1 shows a display example of the variably display portion 3B in the above process. In this example, if the reel display portion is held once, this reel display portion is held until the free game is terminated.

Figure 1B:
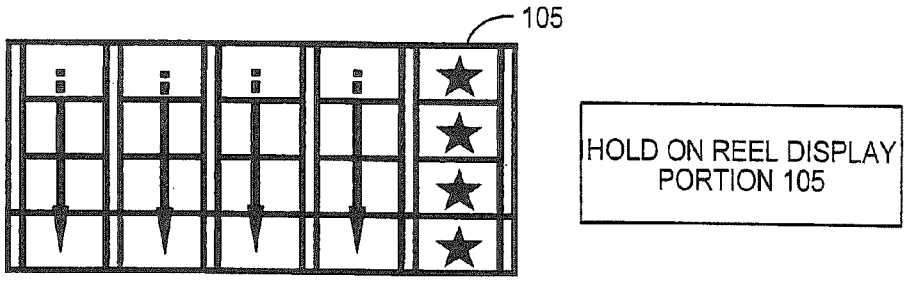

As shown in FIG. 1A, if only the WILD symbols are displayed on the reel display portion 105, the reel on the reel display portion 105 will be held as shown in FIG. 1B in next game.

Figure 1C:
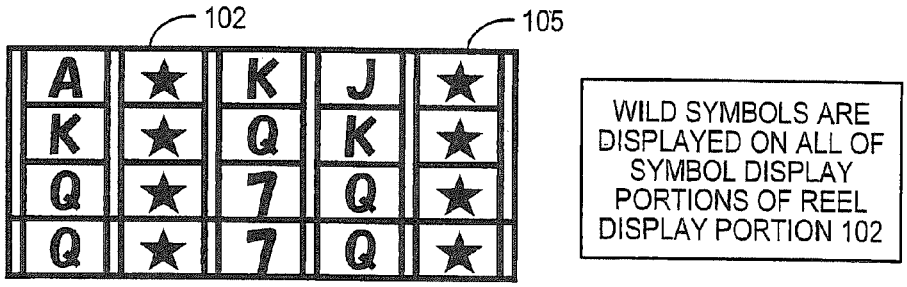
Figure 1D:
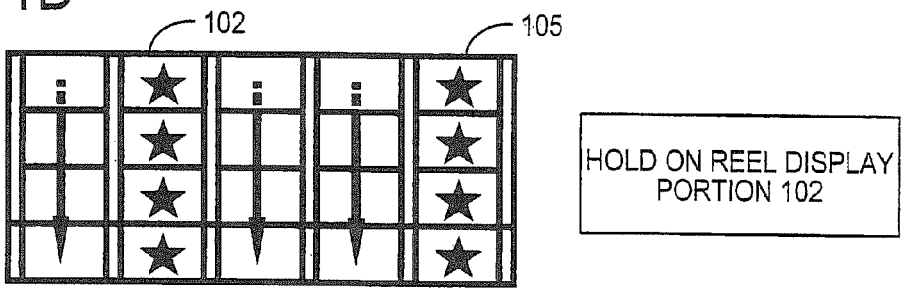

Also, as shown in FIG. 1C, if only the WILD symbols are displayed on the reel display portion 102 in the next game, the reels on the reel display portions 102 and 105 will be hold in a next game.

By repeatedly executing the above process, the probability where the WILD symbols fill on the all of symbol display portions on the variably display portion 3B can be enhanced.

(Free Game of Second Embodiment)

Next, a flowchart of a free game in which each of the reel display portions has a flag will be described. Each of the reels has a flag. These flags are stored in the RAM 43 for example. The flag can "0" or "1". Also, "1" indicates that the reel display portion is to be held, and "0" indicates that the reel display portion is to be variably displayed. Also, correspondence relationship between flag state and indication is variable.

Figure 22:
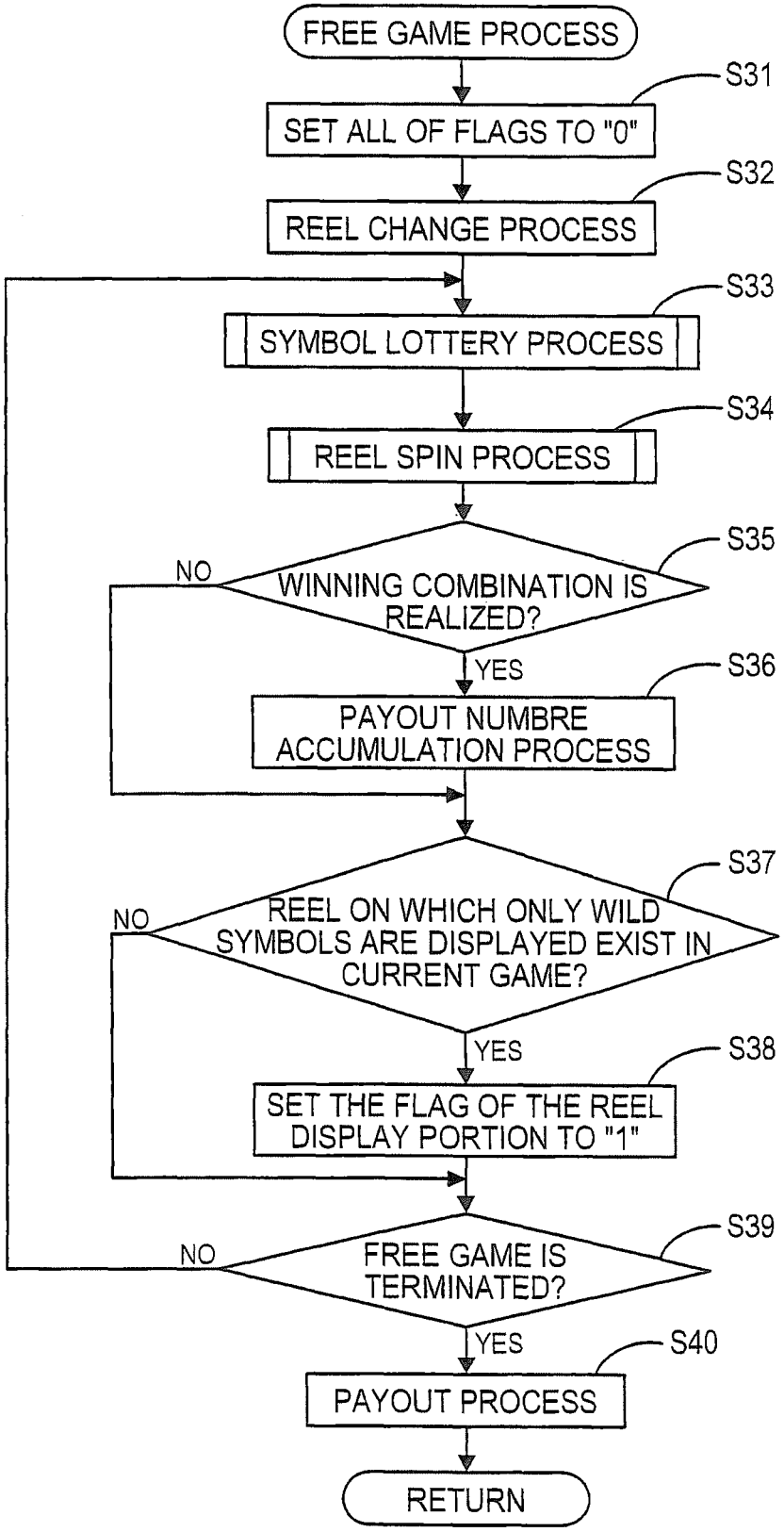
FIG. 22 is a table in which reel display portions correspond to flags in the slot machine according to one or more aspects of the invention.

The free game related to the embodiment will be described with reference to drawings. FIG. 22 is a flowchart of the free game of the embodiment.

First, in S31, all of the flags are set to "0" (namely, cleared). This process is executed before a lottery process which will be described later. The process of S31 can be executed at another time within that it executed before the lottery process. For example, the above process can be executed after the free game is terminated.

In S32, the reel change process is executed. Since this process is the same as S21, explanation thereof is omitted.

Figure 23:
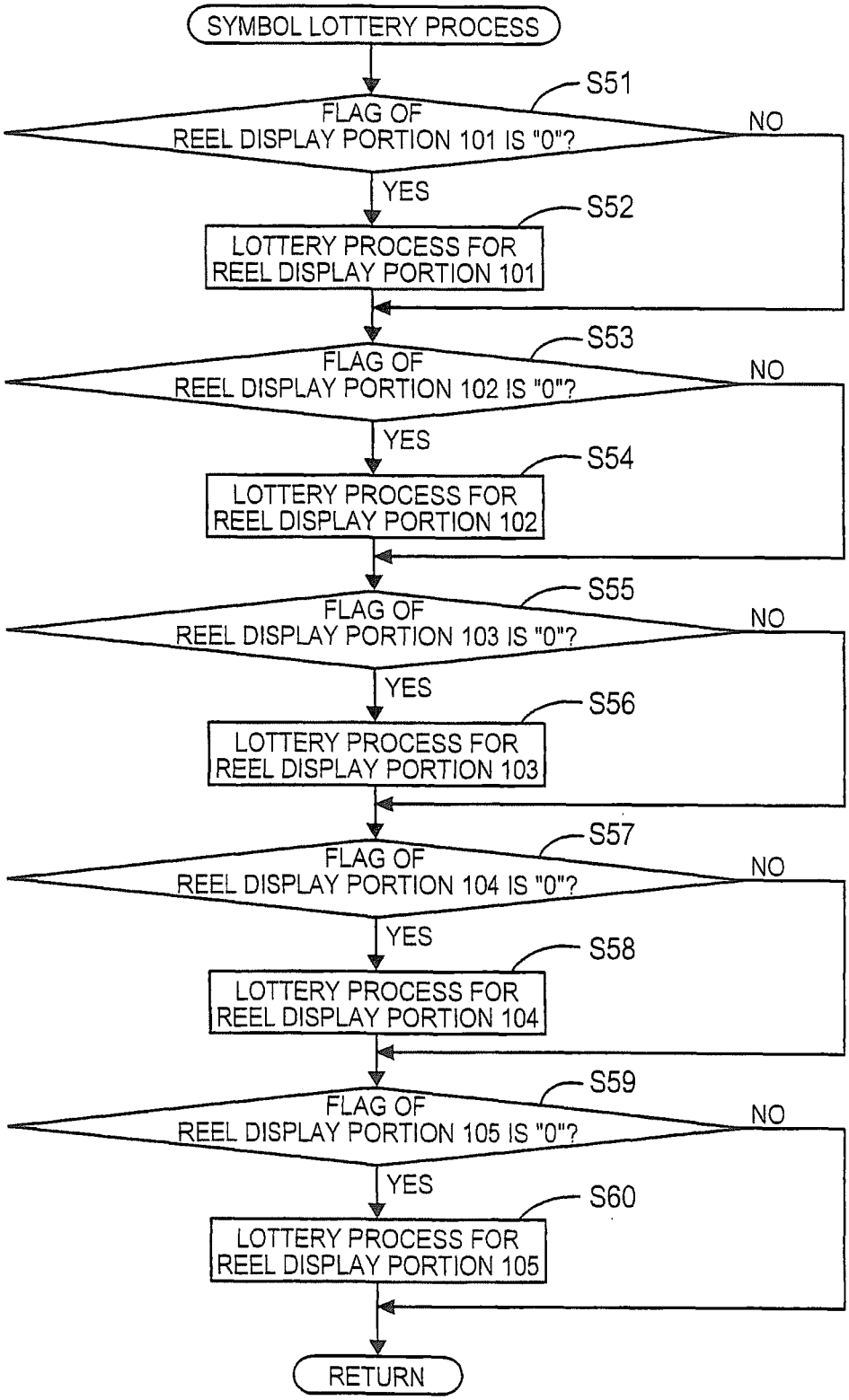
FIG. 23 is a flowchart of a free game process in the slot machine according to one or more aspects of the invention.

A symbol lottery process of S33 will be described in detail with reference FIG. 23. FIG. 23 is a flowchart of the symbol lottery process of the free game in this embodiment.

In S51, the flag of the reel display portion 101 is checked. If the flag is "0" (S51:YES), the procedure will be shifted to S52. On the other hand, if the flag is "1" (S51:NO), the procedure will be shifted to S53. In S52, the lottery process is executed on the reel display portion 101. Since content of the lottery process is the same as the lottery process of S22, explanation thereof is omitted.

In S53, the flag of the reel display portion 102 is checked. If the flag is "0" (S53:YES), the procedure will be shifted to S54. On the other hand, if the flag is "1" (S53:NO), the procedure will be shifted to S55. In S54, the lottery process is executed on the reel display portion 102. Since content of the lottery process is the same as the lottery process of S22, explanation thereof is omitted.

In a similar way, with respect to the reel display portions 103 to 105, above processes are executed. After that, the processes are terminated. In the above processes, a sequence of determination for the reel display portion is 101, 102, 103, 104, and 105, however, one or more aspects of the invention, the above process may be executed in other sequence. Also, in one or more aspects of the invention, the process which is same as S22 can be executed regardless of the state of the flag. In this case, since conditional judgment process of S33 (namely, S51, S53, S55, S57, and S59) is not necessary, the process of the one or more aspects of the invention may be simplified.

Figure 24:
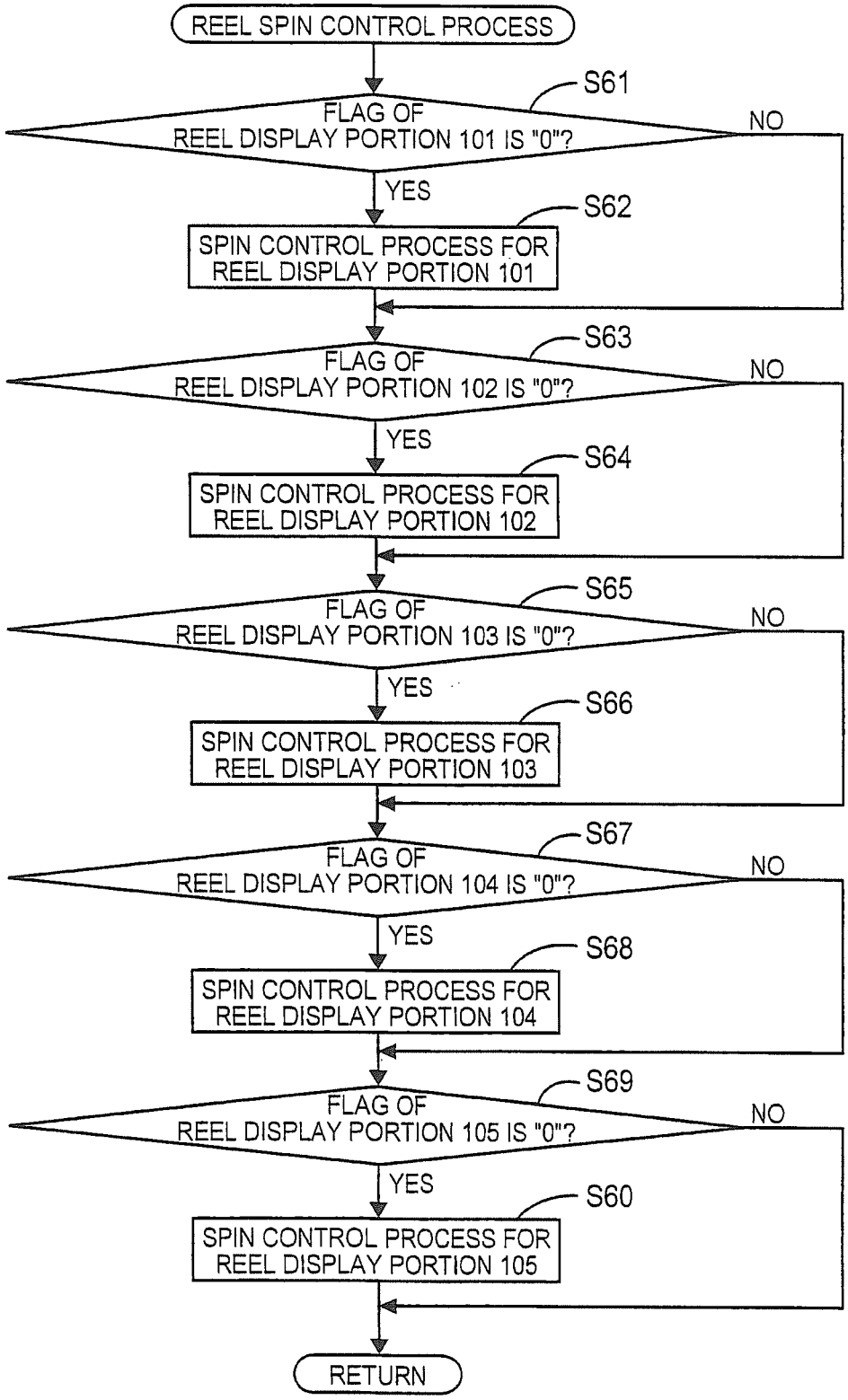
FIG. 24 is a flowchart of a symbol lottery process in the slot machine according to one or more aspects of the invention.

A reel spin process of S34 will be described in detail with reference to FIG. 24. FIG. 24 is a flowchart of the spin process of the free game in this embodiment.

In S61, the flag of the reel display portion 101 is checked. If the flag is "0" (S61:YES), the procedure will be shifted to S62. On the other hand, if the flag is "1" (S61:NO), the procedure will be shifted to S63. In S62, the spin control process is executed on the reel display portion 101. Since content of the spin process is the same as the spin control process of S23, explanation thereof is omitted.

In S63, the flag of the reel display portion 102 is checked. If the flag is "0" (S63:YES), the procedure will be shifted to S64. On the other hand, if the flag is "1" (S63:NO), the procedure will be shifted to S65. In S64, the spin control process is executed on the reel display portion 102. Since content of the spin process is the same as the spin control process of S23, explanation thereof is omitted.

In a similar way, with respect to the reel display portions 103 to 105, above processes are executed. Here, in the above process, the spin control process is executed every determination of the flag, however, one or more aspects of the invention can be controlled so that all of the flags are checked, and then, the spin control process can be executed on the reel display portion(s) corresponding to "0" flag.

Since processes of S35 and S36 (see FIG. 22) are the same as the processes of S24 and S25, explanation thereof is omitted.

In S37, with respect to each of the reel display portions, it is determined that the WILD symbols are displayed on all of the symbol display portions in current game. If it is determined that the WILD symbols are displayed on all of the symbol display portion (S37:YES), the flag corresponding to the reel display portion on which the only WILD symbols are displayed is set to "1" (S38).

In S39, it is determined whether or not the free game is terminated. This determination is based on whether the free game is executed with the predetermined number. If it is determined that the free game is not terminated (S39:NO), the procedure will be returned to S33 and the process is executed. On the other hand, if it is determined that the free game is terminated (S39:YES), the procedure will be shifted to S40 and the accumulated payout number will be provided to the provided. After that, the free game is terminated.

Here, each of the flowcharts as mentioned above is a merely example, and one or more aspects invention may be implemented by other flowchart(s) which can obtain the same result of above processes.

FIG. 25 shows a correspondence relationship between the reel display portions and the flags in above process. As shown in FIG. 25A, if the WILD symbols are displayed on all of the symbol display portions of the reel display portion 105, the flag corresponding to the reel display portion 105 is set to "1". And then, as shown in FIG. 25B, the reel display portion 105 is held in next game.

Figure 25A:
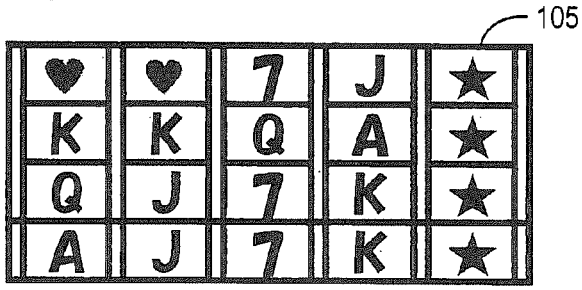
FIG. 25 is a flowchart of a reel spin control process in the slot machine according to one or more aspects of the invention.
Figure 25B:
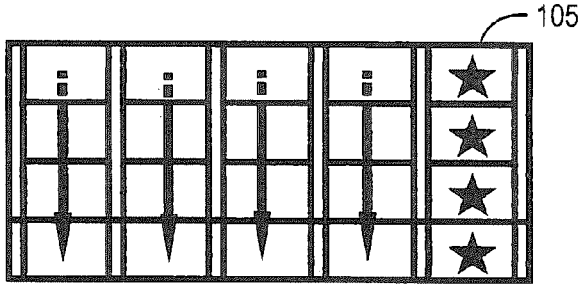
Figure 25C:
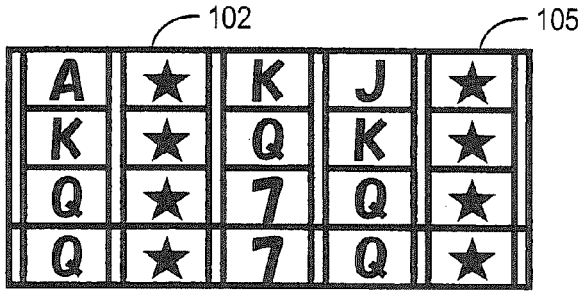
Figure 25D:
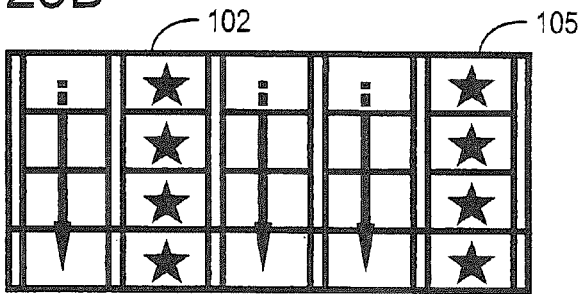

As shown in FIG. 25C, if the WILD symbols are displayed on all of the symbol display portions of the reel display portion 102, the flag corresponding to the reel display portion 102 is set to "1". And then, as shown in FIG. 25D, the reel display portions 102 and 105 are held in next game.

As mentioned above, since the processes are executed using the flags stored in the RAM 43 or the like, the free game is implemented by software and hardware resources which are cooperatively working.

As mentioned above, in the slot machine 1 according to the embodiments, if the predetermined condition is met and the free game is shifted (S18), reels is changed to reels to be used in the free game (S21). Also, in the free game, reel display portion on which the WILD symbols are displayed on all of the symbol display portions (S26:YES), the reel display portion is held in following games (S27). The WILD symbols are consecutively displayed with the predetermined number (which is greater or equal to the number of symbol display portions of one reel display portion) on the reels used in the free game. Therefore, as shown in FIG. 22, the probability where WILD symbols fill on the all of the can be enhanced, one or more aspects of the invention can provide higher interest to the player.

The present invention is not limited to above embodiments and various changes and modifications can be done within the scope of the present invention certainly. For example, in a case where one or more aspects of the invention are implemented by the hybrid type slot machine which has the mechanical reels and transparent liquid crystal display device, the mechanical reels can be used in the base game and video reels displayed on the transparent liquid crystal display device can be used in the free game. Also, in the same game, some reel can be implemented by the mechanical reel and other reel can be implemented by the video reel. Further, one or more aspects of the invention may have a third special reel which is more beneficial. Also, in the free game, if a predetermined condition is met, the third special reel may be used.

Figure 26A:
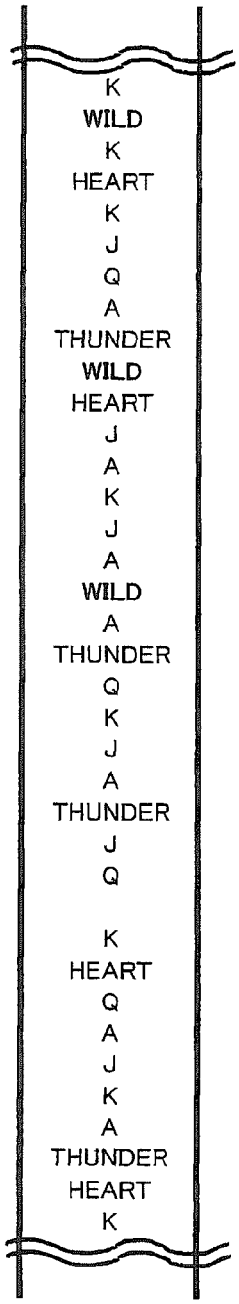
FIG. 26 is a view showing reels in the slot machine according to one or more aspects of the invention.
Figure 26B:
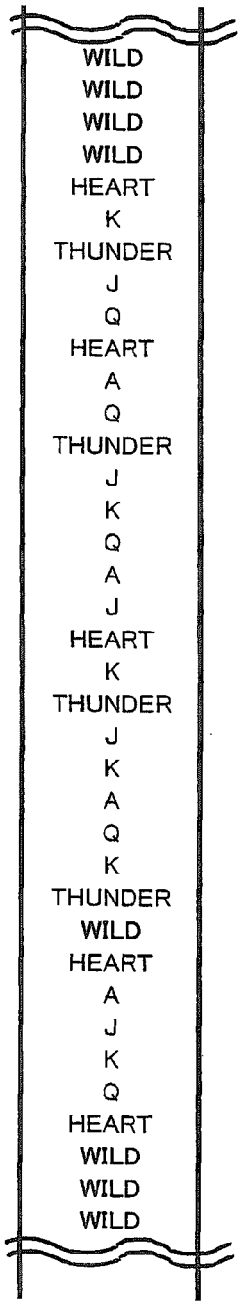
Figure 26C:
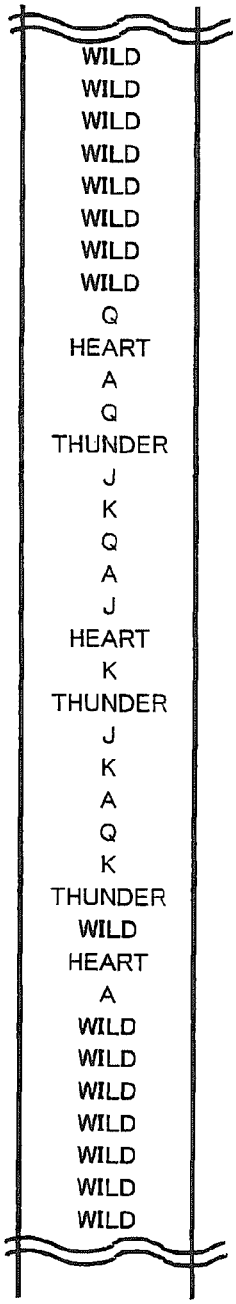

Also, different reels can be used on different display portions based on the condition of shifting to the free game. That is, as shown in FIG. 26, two types of the beneficial reels for the player may be provided and reel shown in FIG. 26C may be used in the reel display portion on which a scatter symbol is displayed, and reel shown in FIG. 26B may be used in the reel display portion on which the scatter symbol is not displayed. Here, the reel shown in FIG. 26C is beneficial for the player compared to the reel shown in FIG. 26B.

Also, one or more aspects of the invention can be implemented as a playing method to execute above processes. Further, one or more aspects of the invention can be implemented as a program to execute above processes in one or more computers, and a tangible medium in which the program is stored.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A gaming machine comprising:

a display that displays plural symbols including predetermined symbols with a matrix shape after first reels are stopped, the matrix shape having N rows and M columns, and a processor that controls the display;

wherein at least N of the predetermined symbols are consecutively arranged on each of the first reels so that the predetermined symbols are able to be displayed in all areas along a column direction, and wherein the processor (a) determines whether N of all symbols displayed on a column is the predetermined symbols, (b) holds the column on which N of the predetermined symbols are displayed in a next game, and (c) changes the first reels to second reels that include more number of the predetermined symbols than the first reels when a predetermined condition is met.

2. The gaming machine according to claim 1, wherein the predetermined symbol is a wild symbol.

3. The gaming machine according to claim 1, wherein when the process (b) is repeated in at least M times, the processor displays N of the predetermined symbols in each of the columns and holds all columns on each of which N of the predetermined symbols are displayed.

4. A method conducted in a gaming machine comprising:

a display that displays plural symbols including predetermined symbols with a matrix shape after first reels are stopped, the matrix shape having N rows and M columns, and a processor that controls the display and conducts a game;

wherein at least N of the predetermined symbols are consecutively arranged on each of the first reals so that the predetermined symbols are able to be displayed in all areas along a column direction, and the method comprising:

(a) determining whether N of the all symbols displayed in a column is the predetermined symbols, (b) controlling the display to hold the column on which N of the predetermined symbols are displayed in a next game, and (c) changing the first reels to second reels that include more number of the predetermined symbols than the first reels when a predetermined condition is met, wherein the (a), (b) and (c) are executed by the processor.

5. The method according to claim 4, wherein the predetermined symbol is a wild symbol.

6. The method according to claim 4, wherein when the process (b) is repeated in at least M times, the processor displays N of the predetermined symbols in each of the columns and holds all columns on each of which N of the predetermined symbols are displayed.

* * * * *